United States Patent [19]

Sims

[11] Patent Number: 5,058,215

[45] Date of Patent: Oct. 22, 1991

[54] TOILET SEAT LIFTER

[76] Inventor: Charles C. Sims, 4214 E. Windsong Dr., Phoenix, Ariz. 85044

[21] Appl. No.: 634,035

[22] Filed: Dec. 26, 1990

[51] Int. Cl.[5] ..... A47K 13/10

[52] U.S. Cl. ..... 4/251; 16/111 R

[58] Field of Search ..... 4/251; 16/110 R, 111 R

[56] References Cited

U.S. PATENT DOCUMENTS

| | | | |
|---|---|---|---|
| 4,574,401 | 3/1986 | Nakajima | 4/251 |
| 4,742,582 | 5/1988 | Giallourakis | 4/251 |
| 4,805,246 | 2/1989 | DeVargas et al. | 4/251 |
| 4,843,656 | 7/1989 | Forman | 4/251 |
| 4,850,062 | 7/1989 | Gibson et al. | 4/251 |
| 4,875,251 | 10/1989 | Hazard | 16/111 R |
| 4,920,586 | 5/1990 | Giallourakis | 4/251 |

*Primary Examiner*—Henry J. Recla
*Assistant Examiner*—Scott Flanders
*Attorney, Agent, or Firm*—David G. Rosenbaum

[57] ABSTRACT

A toilet seat lifter for attachment to a toilet seat as an aid for raising and lowering the toilet seat without the need to actually touch the toilet seat. The lifter attaches to the bottom of the toilet seat and engages with the spacer bumper common on the bottom of toilet seats. When the lifter is attached to the bottom of the toilet seat, the handle portion of the lifter extends beyond the peripheral edge of the toilet seat.

10 Claims, 1 Drawing Sheet

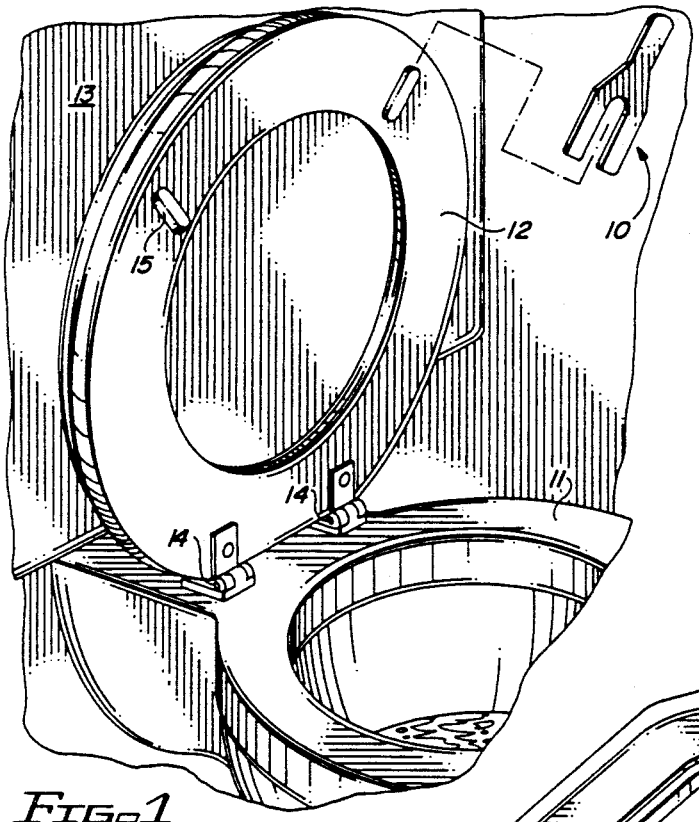
FIG. 1
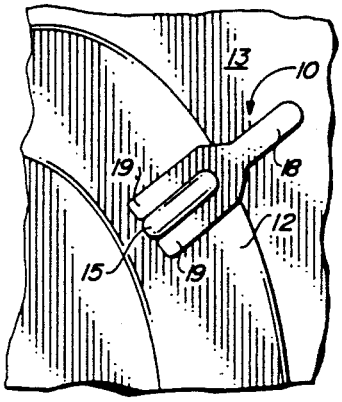
FIG. 6
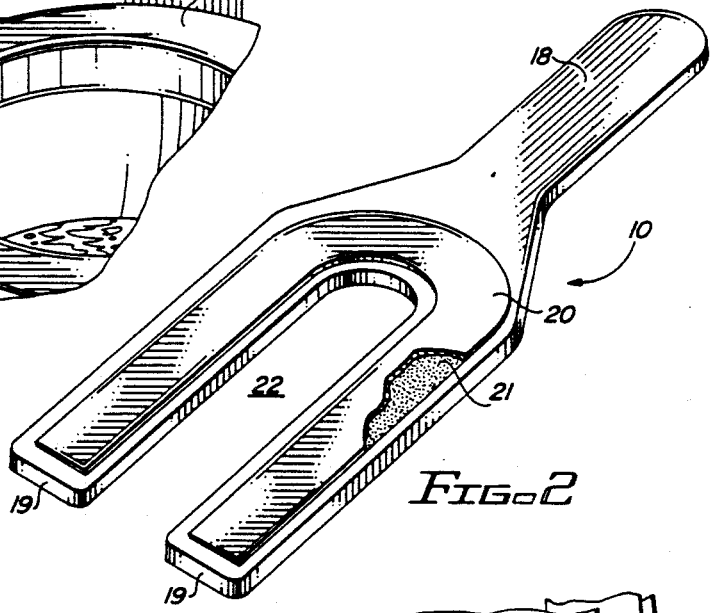
FIG. 2
FIG. 3
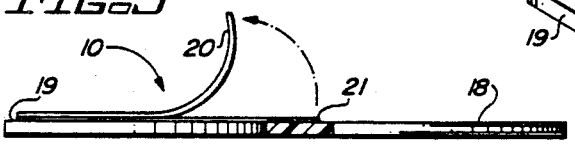
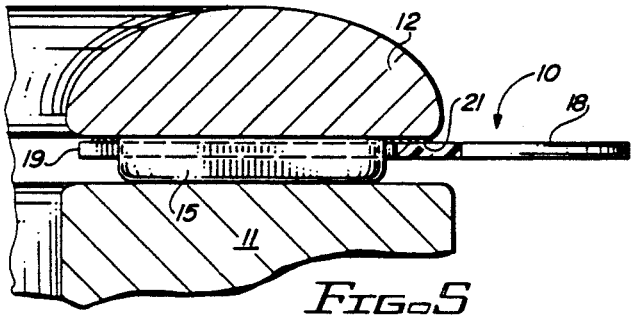
FIG. 5
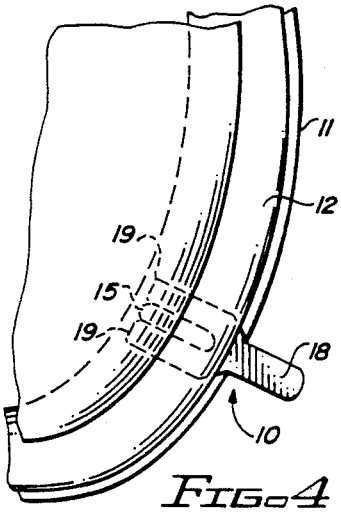
FIG. 4

TOILET SEAT LIFTER

BACKGROUND OF THE INVENTION

1. Field of the Invention

This invention relates to sanitary accessories for toilet seats and, specifically, to an easily attached handle to assist in the lifting and lowering of the toilet seat.

2. Discussion of the Prior Art

One of the problems with toilet seats is that, due to the nature of their use, they frequently become unsanitary. This problem is especially acute with public facilities. The use of toilet seats also frequently involves the need to either raise or lower the toilet seat. Traditionally, this has been done by the user manually grasping the toilet seat and moving it to the desired position.

The unsanitary nature of toilet seats has created a need for a means to allow a user to raise or lower a toilet seat without coming into direct contact with the toilet seat. It is also advisable that such means be easily attached to the toilet seat and easy to locate.

SUMMARY OF THE INVENTION

The present invention provides a relatively simple and inexpensive solution to the problems identified above. The invention provides a novel means for raising and lowering a toilet seat. The invention incorporates a handle which extends beyond the peripheral edge of the toilet seat allowing the user to grasp the extending handle to raise and lower the toilets seat; opposing protrusions to engage a spacer bumper on the bottom of the toilet seat; and means for attaching the device to the bottom of the toilet seat.

BRIEF DESCRIPTION OF THE DRAWINGS

FIG. 1 is an exploded view of the underside of a toilet seat indicating the engagement of the invention therewith.

FIG. 2 is a perspective partial cut-away view of the invention.

FIG. 3 is a side elevational partial cross-sectional view of the invention indicating the partial removal of a protective backing for an adhesive material in accordance with the present invention.

FIG. 4 is a top elevational view of a lowered toilet seat illustrating the present invention attached thereto.

FIG. 5 is a cross-sectional view of a lowered toilet seat illustrating the invention attached thereto and engaging the toilet seat spacer bumper.

FIG. 6 is an elevational view of a raised toilet seat illustrating the present invention attached thereto and engaging the toilet seat spacer bumper.

DETAILED DESCRIPTION OF THE PREFERRED EMBODIMENT

FIG. 1 shows a conventional toilet assembly, including a bowl 11, seat 12 and tank 13. The seat 12 is shown in the raised position. The seat is attached by means of two conventional hinges 14 attached to the bowl 11 to facilitate raising and lowering of the seat 12. In FIG. 1, the underside of the toilet seat having two spacer bumpers 15 is shown. FIG. 1 also shows the toilet seat lifter 10 of the present invention and its relative position in use.

FIG. 2 shows an enlarged perspective view of the toilet seat handle 10 according to its preferred embodiment. The invention consists generally of a rigid planar Y-shaped member having a single protrusion 18 extending in one direction and two leg protrusions 19 which extend in a direction opposite from the handle protrusion 18. The two leg protrusions 19 define an open slot 22 between them. Open slot 22 is adapted to receive and engage a spacer bumper 15 on the underside of the toilet seat 12. The manner in which the open area between the two protrusions 19 engages the toilet seat bumper 15 is shown in FIG. 6 and is further described below.

FIG. 2 also shows an attachment means 21 which is preferably comprised of double-coated adhesive tape 21 and removable backing 20. Attachment means 21 is attached to a top surface of the leg protrusions 19. Removable backing 20, when removed, exposes the adhesive 21. In FIG. 2, the removable backing 20 is shown in a partial cut-away view. The adhesive 21 and backing 20 are also shown in FIG. 3.

FIG. 3 shows a side elevational view of the invention 10. This view shows the handle 18 extending in one direction with one of the leg protrusions 19 extending in an opposing direction. One side of the adhesive tape is firmly attached to the leg protrusion 19. The other side of the adhesive tape is shown with the removable backing 20 which is partially peeled away in FIG. 3. During installation, backing 20 is removed and the device 10 is attached to the underside of the toilet seat by means of the adhesive 21.

The manner in which the toilet seat lifter 10 is attached to the toilet seat 12 is best shown in FIG. 5. The toilet seat 12 is shown in the lowered position, with the spacer bumper 15 in contact with the toilet bowl 11. It can be seen that the invention 10 is attached to the toilet seat 12 by means of the adhesive 21. The adhesive 21 attaches the leg protrusions 19, shown partially in phantom, to the underside of the toilet seat 12. The leg protrusions 19 preferably engage the spacer bumper 15 within the open slot 22 and extend on either side of the spacer bumper 15. In this position, the handle 18 extends beyond the outer peripheral edge of the toilet seat 12 to facilitate lifting.

FIG. 4 shows the toilet seat handle lifter 10 attached to the toilet seat 12 from a top elevational view. This view shows the protrusions 19, in phantom, extending on either of side of the spacer bumper 15 and thereby engaging the spacer bumper. The handle 18 extending beyond the outer peripheral edge of the toilet seat 12 is also shown. From the lowered position, the handle device 10 can easily be used to lift the toilet seat without the user ever touching the toilet seat or the toilet bowl.

FIG. 6 shows the toilet seat 12 in the raised position. The lifter 10 is shown attached to the underside of the toilet seat 12. When attached to the underside of the toilet seat, the toilet seat spacer bumper 15 receives the toilet seat handle 10 within the open slot 22 defined by the two leg protrusions 19. From this FIG. 6 it can also be seen that the toilet seat handle 18 extends beyond the outer peripheral edge of the toilet seat 12. The toilet seat handle extending beyond the outer peripheral edge of the toilet seat 12 allows a person to grasp the handle and lower the toilet seat without touching the toilet seat 12.

In accordance with the preferred embodiment of the invention, the rigid planar Y-shaped member 10 is preferably formed of a unitary molded or die-cut plastic material, such as polycarbonate, polyvinylchloride or the like. The plastic material may include a phosphorescent material. The adhesive 21 and backing 20 are preferably constructed from a double-sided adhesive tape made of a non-absorbent acrylic closed-cell foamed adhesive, such as that sold by 3M of St. Paul, Minn. under the trademark SCOTCH VHB. The adhesive 21 is preferably about 0.4 mm to about 3 mm thick, such that the total thickness of the adhesive and Y-shaped member does not exceed the height of the spacer bumper.

Those skilled in the art will understand, from the foregoing, that the invention has been described with reference to its preferred embodiments, and that substitutions or changes in materials or configuration may be made and still fit within the spirit and scope of the present invention, which is intended to be limited only by the accompanying claims, appended hereto.

I claim:

1. A toilet seat handle lifting device comprising:

a unitary rigid planar substantially Y-shaped member having a handle protrusion extending in one direction and having a pair of leg protrusions extending in an opposing direction, said leg protrusions defining an open slot therebetween adapted to receive a toilet seat spacer bumper common therein, whereby said handle protrusion extends beyond an outer peripheral edge of the toilet seat; and attachment means for securely attaching said device to the bottom side of the toilet seat.

2. The toilet seat handle lifting device of claim 1 wherein said Y-shaped planar member further comprises a plastic material.

3. The toil seat handle lifting device of claim 2 wherein said plastic material further comprises a polycarbonate material.

4. The toilet seat handle lifting device of claim 3 wherein the adhesive material further comprises a double-sided adhesive tape.

5. The toilet seat handle lifting device of claim 2 wherein said plastic material further comprises a polyvinylchloride material.

6. The toilet seat handle lifting device of claim 4 wherein the adhesive consists of double-coated acrylic closed cell foam adhesive tape.

7. The toilet seat handle lifting device of claim 2 wherein said toilet seat handle lifting device is further comprised of a die cut plastic material.

8. The toilet seat handle lifting device of claim 2 wherein said toilet seat handle lifting device is further comprised of a molded plastic material.

9. The toilet seat handle lifting device of claim 1 wherein said Y-shaped planar member further comprises a phosphorescent material.

10. The toilet seat handle lifting device of claim 1 wherein said attachment means further comprises an adhesive material.

* * * * *